United States Patent [19]

Berger et al.

[11] Patent Number: 4,557,305

[45] Date of Patent: Dec. 10, 1985

[54] CUTTER BLOCK FOR A MOTOR DRIVEN HAND PLANER

[75] Inventors: Günther Berger, Notzingen; Alfred Frech, Stuttgart, both of Fed. Rep. of Germany

[73] Assignee: Robert Bosch GmbH, Stuttgart, Fed. Rep. of Germany

[21] Appl. No.: 517,352

[22] Filed: Jul. 25, 1983

[30] Foreign Application Priority Data

Oct. 22, 1982 [DE] Fed. Rep. of Germany ..... 3239152

[51] Int. Cl.[4] ..... B26D 1/12

[52] U.S. Cl. ..... 144/230; 144/117 R; 144/241; 407/43

[58] Field of Search ..... 144/117 R, 114 R, 218, 144/230, 240, 241; 407/33, 43, 51

[56] References Cited

U.S. PATENT DOCUMENTS 2,846,904 8/1958 Dow ..... 144/230

3,688,367 9/1972 Bennett ..... 407/43

*Primary Examiner*—W. D. Bray

*Attorney, Agent, or Firm*—Michael J. Striker

[57] ABSTRACT

A cutter block for a motor driven hand planer includes a roller body which is composed of two profiled bodies of equal cross section. The two profiled bodies cooperate with each other to grip a planing knife therebetween. Between the profiled bodies and a supporting shaft, centering spring elements are provided in respective recesses of the shaft. For tightening the profiled body and gripping of the interposed planing knives, shank screws are used which extend through the roller body. Perpendicular to the shank screws and parallel to the gripping surfaces of the profiled bodies are adjusting screws for transverse movement of the profiled bodies relative to each other and with respect to the shaft. Consequently, the position of the planing knife is adjustable.

20 Claims, 5 Drawing Figures

CUTTER BLOCK FOR A MOTOR DRIVEN HAND PLANER

BACKGROUND OF THE INVENTION

The invention relates to a cutter block for a motor driven hand planer.

From the European patent application No. 0048303, there is known a cutter block in which a one-piece roller body is provided with adjusting and tightening means for conventional planing knives. Symmetric to the rotational axis of the roller body, two groups of gripping surfaces for a respective knife, a clamping holder and a pressing strip are fixed to the roller body. The basic body is provided with five tapped holes perpendicular to these gripping surfaces and extending through the longitudinal axis of the basic body. Two holding screws are screwed into these tapped holes from each side for fastening a respective one of the clamping holders and a knife held by the respective clamping holder. Through the provision of a longitudinal groove in the knife and a corresponding corrugation on the clamping holder, a form lock is obtained between the clamping holder and the knife. For adjusting the knife, oblong holes are provided in the clamping holder through which five screws are guided. The adjusted position of the knife is maintained by two holding screws of the clamping holder. Thereafter, the knife and the clamping holder are fixedly pressed to the basic body by the pressing strip by means of three tightening screws provided in the remaining tapped holes.

Although such a cutter block permits the adjustment of the respective knife, it exhibits nevertheless the inherent disadvantage that the construction and the design of the entire cutter block as well as the provision to adjust the knife is rather cumbersome.

A further cutter block is disclosed in the European patent application No. 008798. The cutter block is a one-piece roller body which is provided with longitudinal bore holes in the vicinity of the roller shell and extending into the roller shell. Inserted in these longitudinal bore holes is a special knife bolt. The knife bolt is produced by milling two cylindrically opposing longitudinal grooves in a rod of circular cross section. Consequently, four cutting edges are obtained which can successively be used. The knife bolts within the longitudinal bore holes are permanently kept within the same position by tightening screws which can be tightened through the roller body against the knife bolts. This cutter block has also several disadvantages. The machining of the roller basic body is rather cumbersome and expensive and moreover, the cutting edges of the knife bolts cannot be adjusted into different positions in the roller shell of the roller body. Finally, conventional planing knives cannot be used.

SUMMARY OF THE INVENTION

It is, therefore, an object of the present invention to avoid the prior-art disadvantages.

In particular, it is an object of the invention to provide a cutter block for a motor driven hand planer which is easily manufactured and allows the adjustment of the planing knife.

Yet another feature of the invention is to provide a cutter block which permits the use of any conventional planing knife.

A concomitant object of the present invention is to provide a cutter block for a motor driven hand planer which is reliable in operation and inexpensive nevertheless.

In keeping with these objects and with others which will become apparent hereinafter, one feature of the invention resides in a cutter block for a motor driven hand planer which comprises a roller body having two profiled bodies cooperating with each other so as to support at least one removable knife, means for supporting and driving the roller body and means for tightening the profiled bodies for gripping the knife.

Through the use of preshaped parts, the cutter block can easily be assembled without necessitating any further treatments and may for example in a drilling jig be simultaneously provided with bore holes for tightening and adjustment. The assembly of the roller body with two profiled bodies of the same cross section is very economical. The profiled body can simply be cut from a profile rod produced for example by extrusion.

According to a further feature of the invention, the connection between the two profiled bodies is obtained by a shaft which commonly supports the profiled bodies and by resilient means interposed between the profiled body and the shaft for centering the profiled bodies. The shaft may be of rectangular cross section or of circular cross section and includes at least one recess in which the resilient means engage. The resilient means can be provided as tolerance rings or O-shaped spring rings or as cup springs.

According to another feature of the present invention, the profiled bodies as well as the shaft are provided with at least one bore hole in alignment with each other through which a shaft screw is guided which is used for tightening the profiled body in the planing knife which is clamped between gripping surfaces defined by the profiled bodies. For adjusting the position of the knife, at least one further bore hole in the profiled bodies as well as in the shaft is provided, which bore holes are in alignment with each other and in which respective adjusting screws are inserted.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 6 is a detail view showing a spring washer under a nut according to the invention;

FIG. 7 is a view similar to that in FIG. 6 with the spring washer under a screw head.

DESCRIPTION OF THE PREFERRED EMBODIMENTS

Figure 1:
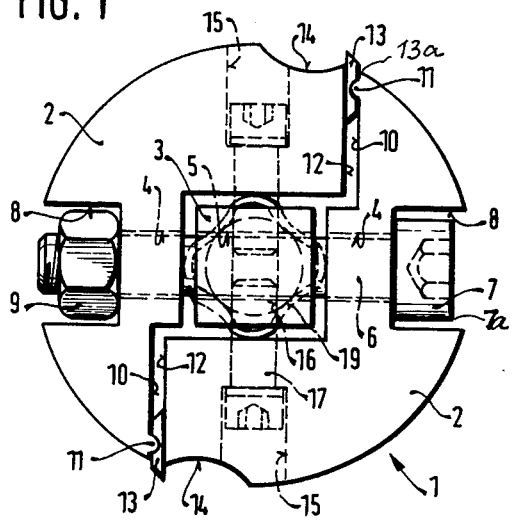
FIG. 1 shows a first embodiment of the cutter block according to the invention, depicting a front face thereof.
Figure 2:
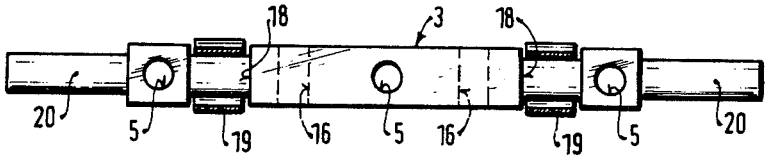
FIG. 2 shows a partial view of the shaft used in the cutter block accordiing to FIG. 1.

Referring firstly to FIGS. 1 and 2, relating to a first embodiment of the cutter block according to the invention, reference numeral 1 is used to characterize a roller body which is composed of two profiled bodies 2 and a square shaft 3 for supporting and connecting the profiled bodies 2. Each of the profiled bodies 2 is provided with a bore hole 4 which is in alignment with a bore hole 5 arranged in the square shaft 3 so as to define a through hole radially extending to the square shaft 3 or rotational axis of the roller body 1. As can be seen from FIG. 2, the shaft 3 is provided with three bore holes 5 which are in alignment with respective bore holes in the profiled bodies 2 so that three through holes are obtained. In elongation of the through holes 4 in the respective profiled bodies 2, counter bores 8 are provided in each profiled body so that respective shaft screws 6 can be inserted through the respective through holes wherein the head 7 of each screw shaft 6 rests in the associated counter bore 8. The other end of the shaft screw 6 which is remote to the head 7 can be screwed in an associated nut 9 which is located in the counter bore 8 of the other profiled body. The head 7 of each shank screw 6 is surrounded by a centering sleeve 7*a* so that the shank screw can be properly inserted into the respective through hole. In order to secure the tightening of the profiled bodies 2 by the shank screws 6, a spring washer 100 may be arranged under the head 7 or the nut 9. Instead of using the nuts 9, it is also possible to use a threaded strip extending over the entire length of the roller body, which threaded strip can be inserted into the counter bore 8. In any case, the width of the counter bore 8 is so dimensioned that they can be used as key for the key faces of the nuts 9.

The two profiled bodies 2 are each provided with two gripping surfaces 10, 12 which cooperate with each other in such a manner that opposing gripping surfaces of the profiled bodies clamp a planing knife therebetween. The gripping surface 10 of each profiled body 2 is provided with an elongated rib 11 and in an assembled state of the roller body 1 faces the other gripping surface 12. The planing knives 13 located between the gripping surfaces 10, 12 are of any conventional type and are provided with a longitudinal corrugation which cooperates with the elongated rib 11 of the gripping surface 10.

The gripping surfaces 10, 12 of each profiled body 2 are located in planes parallel to each other, wherein the gripping surface 10 has a distance to the rotational axis of the roller body which exceeds the distance of the other gripping surface 12 therefrom by the thickness of the knife 13. As can be further seen from FIG. 1, a concave recess 14 extends from the cutting edge of the knife 13.

Each of the profiled bodies 2 is further provided with at least one stepped through hole 15 which extends perpendicularly to the bore holes 4,5 and is in alignment with a respective tapped hole 16 provided in the square shaft 3. Through each of the through holes 15, an adjusting screw 17 is inserted and screwed into the respective tapped hole 16 of the square shaft 3. With these adjusting screws 17, the profiled bodies 2 can be adjusted relative to the square shaft 3 for centering the planing knife 13.

As can be especially seen from FIG. 2, the profiled bodies 2 are further supported by spring elements 19 which are inserted in the respective recesses 18 of the square shaft 3. In the embodiment according to FIGS. 1 and 2, the spring elements 19 are tolerance rings with spaced shafts around the circumference. Shaft journals 20 are further provided for supporting and driving the cutter blocks.

The assembling of the cutter blocks with the planing knives 13 can be easily performed. When loosening the shank screws 6, the knives 13 can be inserted between the gripping surfaces 10 and 12 wherein the corrugation 13*a* of each knife 13 cooperates with the respective elongated rib 11 of the gripping surface 10. After having lightly tightened the shank screws 6, the position of the planing knife 13 can be adjusted by turning the adjusting screw 17. Thereafter, the shank screws 6 are firmly tightened before preparing the cutter block for its use. For replacing or turning the planing knife 13, the shank screws 6 are simply loosened so that the profiled bodies 2 are pressed apart by the spring elements 19. Then, the planing knives 13 can be removed or turned from its support. Since the gripping surfaces 10, 12 which receive the tension forces exerted on the planing knives 13 and the contact surfaces of the profiled body supported by the spring elements 19 are provided in a uniformly balanced manner on each side of the shank screws 6, no shearing forces can occur during assembling and tightening.

Figure 4:
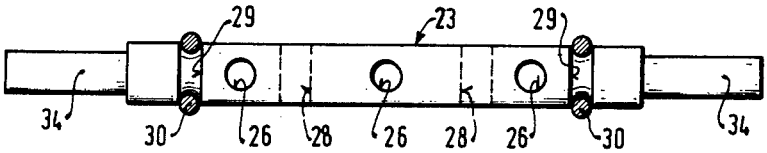
FIG. 4 is a partial view of a shaft to be used in the cutter block according to FIG. 3.
Figure 3:
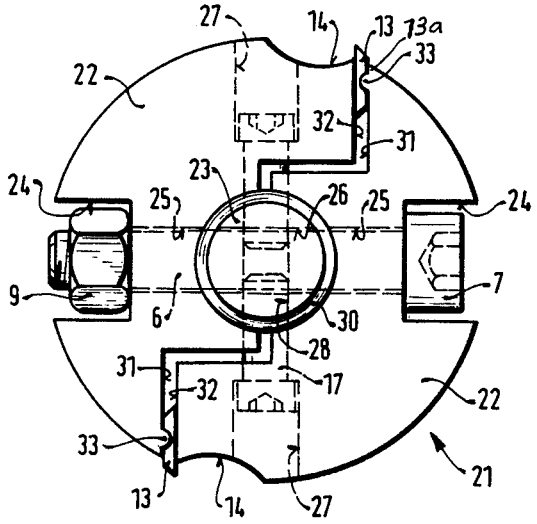
FIG. 3 is a second embodiment of a cutter block according to the invention, depicting one front face thereof.

FIGS. 3 and 4 refer to a second embodiment of the cutter block and show a roller body 21 which is formed by two profiled bodies 22 and one shaft 23 supporting the profiled bodies 22. The shaft 23 has a circular cross section so that the profiled bodies 22 are respectively shaped. Similar to the cutter block as shown in FIG. 1, the profiled body 22 of this second embodiment has indentations 24 and bore holes 25 which are in alignment with bore holes 26 provided in the shaft 23. For tightening the cutter block, the same shaft screws 6 are used. Further, the profiled bodies 22 are provided with stepped through holes 27 which correspond to the stepped through holes 15 of the first embodiment and are in alignment with respective tapped holes 28 provided in the shaft 23. The shaft 23 is provided with recesses 29 in which spring elements 30 are inserted. As can especially be seen from FIG. 4, these spring elements 30 are O-shaped spring rings. Gripping surfaces 31 and 32 of each profiled body 22 are provided for clamping the planing knife 13. In correspondence with the embodiment of FIG. 1, the gripping surface 31 is provided with elongated ribs 33 which cooperate with a respective corrugation in the planing knife 13. Shaft journals 34 connected to the shaft 23 are provided for supporting of and transmission of the drive for the cutter block.

The insertion and the removal of the planing knives 13 is provided in the same manner as described with respect to the first embodiment.

Figure 5:
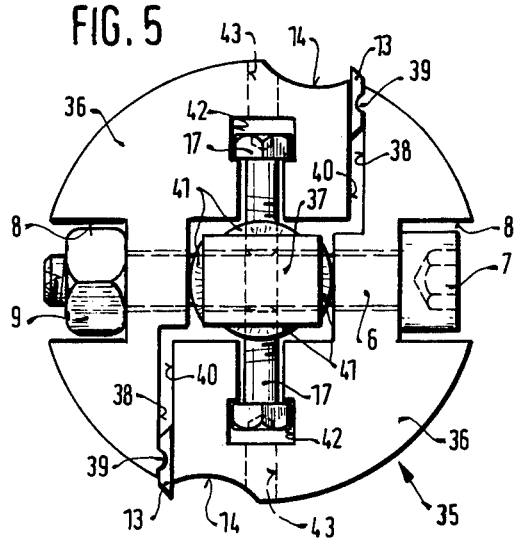
FIG. 5 is a third embodiment of a cutter block according to the invention, depicting a front end face thereof.

FIG. 5 refers to a third embodiment of the cutter block and illustrates a roller body 35 composed of two profiled bodies 36 which are simplified in comparison to the embodiments according to FIGS. 1 and 3. The profiled bodies 33 are supported by a shaft 37 of rectangular cross section. In correspondence with the embodiment according to FIG. 1, the profiled bodies 36 as well as the shaft 37 are provided with aligned bore holes for receiving the shank screws 6. The profiled bodies 36 each include a gripping surface 38 which is provided with an elongated rib 39 and a gripping surface 40 of smooth surface. In distinction to the previous embodiment of the cutter blocks, cup springs 41 are used as resilient means. Moreover, each of the profiled bodies 36 are provided with T-shaped recesses 42 extending from the inner surfaces of the profiled bodies 36 in which recesses the adjusting screws 17 are arranged. Consequently, when the adjusting screws 17 are already screwed to the shaft 37, the profiled bodies 36 can be simply assembled together by sliding the profiled bodies 36 over the adjusting screws 17. Through the provision of such T-shaped recesses 42, the assembling of the cutter blocks is facilitated. Extending from the T-shaped recess 42 to the periphery of the profiled bodies 36 is an adjusting bore hole 43 through which the adjusting screw 17 can be adjusted by means of a key. For example, a hexagonal key can be used for screws with a hexagonal recess hole.

The insertion and tightening of the planing knife 13 is according to the embodiments as explained with regard to FIGS. 1 and 3. In all embodiments, the end portion of the shank screws 6 can be treated for example by a prick punch after the assembly so that the nuts or the threaded strip, respectively, cannot be lost.

All embodiments can be supplemented by using a spring washer to be placed underneath the head 7 or the nut 9 of the shank screws 6. Consequently, the planing knife 13 can be inserted and removed under light spring tension.

It will be understood that each of the elements described above, or two or more together, may also find a useful application in other types of cutter blocks for a motor driven hand planer different from the types described above.

While the invention has been illustrated and described as embodied in a cutter block for a motor driven hand planer, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A cutter block for a motor driven hand planer, comprising:

a roller body having two profiled bodies cooperating with each other so as to support at least one movable knife;

means for supporting and driving the roller body, including a shaft connecting the profiled bodies and provided with at least one recess, and resilient means for centering the profiled bodies with respect to the shaft and located within the recess; and means for tightening the profiled bodies for gripping the knife.

2. A cutter block as defined in claim 1, wherein the resilient means is a spring ring engaging the recess and surrounding the shaft.

3. A cutter block as defined in claim 2, wherein the spring ring is O-shaped.

4. A cutter block as defined in claim 1, wherein the resilient means is a cup spring arranged between the shaft and the profiled bodies.

5. A cutter block as defined in claim 1, wherein the shaft has a rectangular cross section.

6. A cutter block as defined in claim 1, wherein the shaft has a square cross section.

7. A cutter block as defined in claim 1, wherein the shaft has a circular cross section.

8. A cutter block as defined in claim 1, wherein each profiled body defines two gripping surfaces eaeh arranged to receive one such knife and further includes at least one further bore hole extending parallel to the gripping surfaces and radially extending through the two profiled bodies, the shaft having at least one tapped hole in alignment with each further bore hole of the profiled bodies.

9. A cutter block as defined in claim 8, wherein the further bore holes are stepped.

10. A cutter block as defined in claim 8, wherein the tightening means further includes at least two adjusting screws, each of the adjusting screws being screwed into the associated further bore hole of each profiled body and into the associated tapped hole provided in the shaft for adjusting the profiled bodies transverse to the shaft thereby adjusting the position of the respective knife.

11. A cutter block as defined in claim 8, wherein the two gripping surfaces of each profiled body are located in planes parallel to each other, the shaft extending between the planes, wherein one of the gripping surfaces of each profiled body has a distance to the shaft exceeding the distance of the other gripping surface to the shaft by the thickness of the knife.

12. A cutter block as defined in claim 8, wherein the tightening means includes at least one screw element perpendicular to the gripping surfaces of the profiled bodies.

13. A cutter block as defined in claim 12, wherein the profiled bodies have contact faces abutting the resilient means, the gripping surfaces for receiving tension forces exerted on the knife and the contact faces being arranged in a uniformly balanced manner on both sides of a plane defined by the axes of the screw element for preventing shear forces during assembling and tightening.

14. A cutter block for a motor driven hand planer, comprising:

a roller body that rotates around a rotational axis, said roller body having two profiled bodies cooperating with each other so as to support at least one movable knife and each having at least one counterbore opposing each other after assembling of the profiled bodies, each of the profiled bodies being further provided with at least one bore hole radially arranged to the rotational axis of the roller body and extending to the associated counterbore of the respective profiled body;

means for supporting and driving the roller body, including a shaft having at least one further bore hole in alignment with each bore hole arranged in the profiled bodies so that after assembling of the profiled bodies at least one through hole is provided extending from one counterbore of one of the profiled bodies to the other counterbore of the other profiled body; and means for tightening the profiled bodies for gripping the knife.

15. A cutter block as defined in claim 14, wherein the tightening means includes at least one screw element having a head and a nut, the screw element being inserted through the through hole so that the head is arranged at one of the indentations while the nut is located in the other indentation.

16. A cutter block as defined in claim 15, wherein the screw element is a shank screw.

17. A cutter block as defined in claim 15, wherein the tightening means further includes a centering sleeve surrounding the head of the shank screw within the associated indentation.

18. A cutter block as defined in claim 15, wherein the tightening means further includes at least one spring washer arranged underneath the head of the screw element.

19. A cutter block as defined in claim 15, wherein the tightening means further includes at least one spring washer arranged underneath the nut of the screw element.

20. A cutter block for a motor driven hand planer, comprising:

a roller body having two profiled bodies, said profiled bodies each having a profile portion, said profile portions cooperating together to define a predetermined profile, said bodies cooperating with each other so as to support at least one movable knife having a longitudinal axis and a contour corresponding to the predetermined profile so that the knife is positionable in a form locking manner relative to the roller body and transverse to the longitudinal axis of the knife;

means for supporting and driving the roller body; and means for tightening the profiled bodies for gripping the knife.

* * * * *